US005977702A

United States Patent [19]

Nieda

[11] Patent Number: 5,977,702

[45] Date of Patent: Nov. 2, 1999

[54] ELECTRODE DEVICE FOR ELECTRIC DISCHARGE TUBE

[75] Inventor: Yoriyuki Nieda, Kamakura, Japan

[73] Assignee: Technett Co., Ltd., Tokyo, Japan

[21] Appl. No.: 08/929,849

[22] Filed: Sep. 15, 1997

[30] Foreign Application Priority Data

Sep. 19, 1996 [JP] Japan ..... 8-248019

[51] Int. Cl.[6] ..... H01J 17/04

[52] U.S. Cl. ..... 313/491; 313/609; 313/631; 313/632; 313/492

[58] Field of Search ..... 313/491, 492, 313/609, 613, 631, 632

[56] References Cited

U.S. PATENT DOCUMENTS

| | | | |
|---|---|---|---|
| 2,011,981 | 8/1935 | Mulder | 313/613 |
| 2,692,350 | 10/1954 | Arnott | 313/492 |
| 4,117,374 | 9/1978 | Witting | 313/491 |

*Primary Examiner*—Nimeshkumar D. Patel

*Attorney, Agent, or Firm*—Ladas & Parry

[57] ABSTRACT

A tubular glow discharge electrode is formed therein with a slot in which front end parts of support leads are inserted. The slot has a widened center part which defines an opening. The tube-like glow discharge tube is welded at its one end part to one of the support lead so as to be electrical conductive to the same, and is caulked at it's the other end part to the other one of the support leads through the intermediary of an insulator. A filament electrode (ark discharge electrode) carrying an electron-emissive substance is supported to the free end parts of the support leads within the tube-like glow discharge electrode which therefore surrounds the arc discharge electrode with a small gap defined between the glow discharge electrode and the filament electrode. In this arrangement, particles of the electron-emissive substance evaporated and scattered from the filament electrode are soon trapped to the inner surface of the glow discharge electrode without being emitted from the glow discharge electrode, and can be reused as the electron-emissive substance, thereby it is possible to prolong the use life of the electron device.

7 Claims, 5 Drawing Sheets

ELECTRODE DEVICE FOR ELECTRIC DISCHARGE TUBE

BACKGROUND OF THE INVENTION

The present invention relates to an electrode assembly for an electric discharge tube, and in particular to an electrode assembly for an electric discharge tube, which is located at each of opposite ends of the electric discharge tube and which is composed of an arc discharge electrode carrying an electron-emissive substance and a glow discharge tube surrounding the arc discharge tube.

The applicant proposed, as disclosed in Japanese Patent Nos. 1834467 and 1854477, an electrode device for a high bright and long life electric discharge tube, which can effect glow discharge even during arc discharge in the electric discharge tube, and which can prevent electron-emissive substance from being dissipated by evaporation. Such an electrode device is composed of a rod-like arc discharge electrode carrying or containing an electron-emissive substance and a cup-like or tubular glow discharge electrode surrounding the rod-like arc discharge electrode, in combination, and is adapted to trap, at the inner wall of the cup-like or tubular glow discharge electrode, microparticles of the electron-emissive substance which are evaporated and scattered from the arc discharge electrode due to bombardment by ions generated and floating in the electric discharge tube, thereby it is possible to reuse the electron-emissive substance trapped at the inner wall so as to prolong the use life of the electric discharge tube and to prevent the wall surface of the electric discharge tube from blackening due to sticking of the electron-emissive substance.

However, the above-mentioned electrode device offers such a disadvantage that it cannot be easily set up in a thin electric discharge tube formed of a small diameter tube body since it has such a configuration that the rod-like arc discharge electrode is laid by its length in a direction orthogonal to the longitudinal axis of the tube body, and is surrounded by the cup-like glow discharge electrode. Further, it is practically required that a slight gap (of about 0.15 mm) is defined between the inner wall of the tube body and the glow discharge tube, and in order to obtain this gap in a thin tube body, the electrode device should have smaller dimensions, resulting in difficulty of manufacturing the electrode device, and increased manufacturing cost, and accordingly, it is impractical. Further, the rod-like arc discharge electrode should be laid along the center axis of the cup-shape glow discharge electrode in order to expect uniform electric discharge, and accordingly, the alignment thereof is very difficult.

SUMMARY OF THE INVENTION

The present invention is devised in order to solve the above-mentioned disadvantages inherent to the above-mentioned conventional electric discharge tube, and accordingly one object of the present invention is to provide a small-sized electrode device for an electric discharge tube, which can be easily produced and which can be easily fitted in a thin electric discharge tube body.

To the end, according to the present invention, there is provided an electrode device comprising a stem welded to a base of an electric discharge tube body at one end of the latter, two support leads extending through the stem and having one end part connected respectively to base pins projected outward from the base, and the other end part projected inward from the base in a direction axial of the tube body, an arc discharge electrode supported at opposite ends respectively to the other end part of the support leads and carrying an electron-emissive substance, and a tubular glow discharge electrode supported to the other end part of the support leads projected from the stem, and coaxially surrounding the arc discharge electrode.

DESCRIPTION OF THE PREFERRED EMBODIMENTS

The present invention will be explained in detail in preferred embodiment forms of the present invention.

Figure 1:
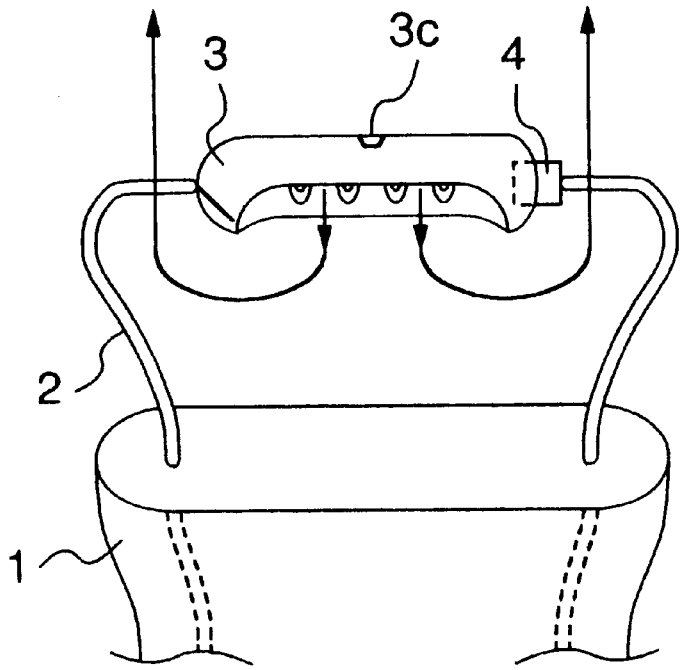
FIG. 1 is a perspective view illustrating an electrode device in one embodiment of the present invention.
Figure 2:
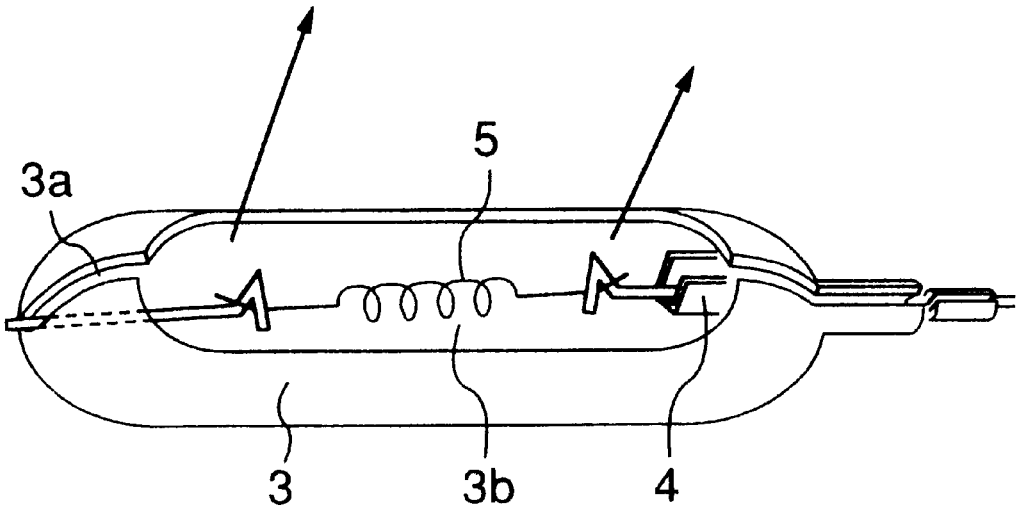
FIG. 2 is a bottom view illustrating the electrode device shown in FIG. 1.

Referring to FIG. 1 which is a perspective view illustrating an electrode device for an electric discharge tube in a first embodiment of the present invention, support leads 2 are extended through a stem 1 projected from a base 14 (refer to FIG. 6) at each of opposite ends of an electric discharge tube body, inward of the latter, in parallel with the longitudinal axis of the tube body, having forward end parts which are bent toward each other in a direction substantially orthogonal to the longitudinal axis of the tube body. A tube-like glow discharge electrode 3 having a canoe shape is supported at opposite ends thereof by the front end parts of the support leads 2. Referring to FIG. 2 which is an enlarged perspective view that shows details of the interior of the tubular glow discharge electrode 3, as viewed from the lower side thereof, the tubular glow discharge electrode 3 is formed therein with a slot 3*a* at the lower side as viewed in FIG. 1 (at the upper side as viewed in FIG. 2). The slot 3*a* through which the front end parts of the support leads 2 are received, has a widened center part defining an opening 3*b*. The tube-like glow discharge electrode 3 is welded at one end to the associated one of the support leads 2 so as to electrically conductive with the latter, but is caulked to the other one of the support leads 2 through the intermediary of an insulator 4. Inside of the tube-like glow discharge electrode 3, the front end parts of the support leads 2 which are bent so as to be extended in a direction orthogonal to the longitudinal axis of the tubular body support at their tip ends a filament electrode carrying an electron-emissive substance or a sintered metal electrode 5 impregnated with an electron-emissive substance. The electrode 5 is extended between the front ends of the support leads 2 so as to serve as an arc electric discharge electrode 3. It is noted that a small hole 3*c* for stabilizing the electric discharge is formed in the upper side of the tube-like glow discharge electrode 3, as viewed in FIG. 1.

Explanation will be made of the operation of the electrode device in the first embodiment of the present invention.

Figure 6:
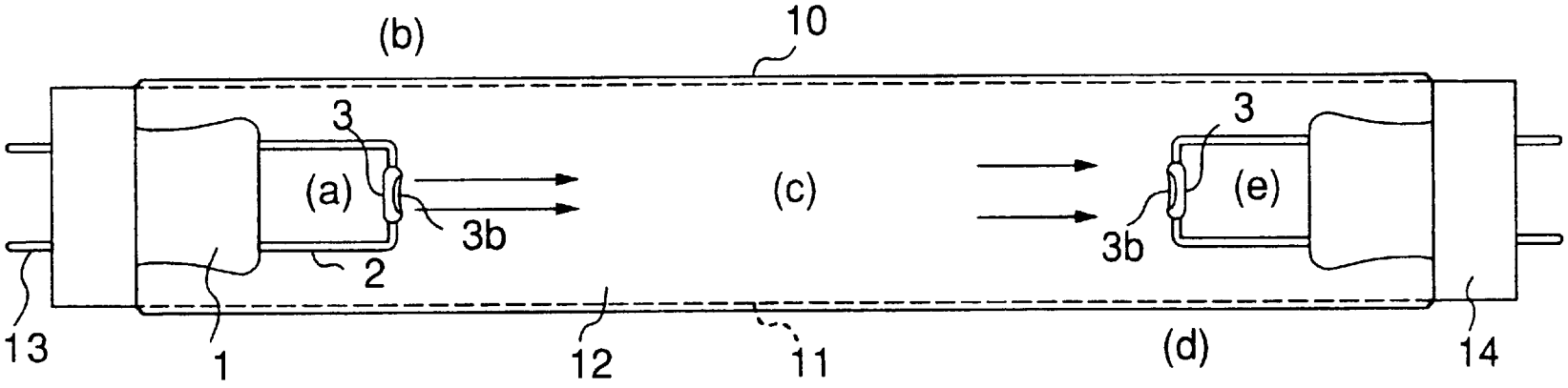
FIG. 6 is a longitudinal sectional view in an example of a fluorescent lamp in which the electrode device according to the present invention is used.

The above-mentioned electrode device is arranged at each of the opposite ends of the electric discharge tube and is applied thereto with a voltage through the base pins 13 (refer to FIG. 6). Thus, the glow discharge electrode 3 initiates glow electric discharge, and then, the arc discharge electrode 3 initiates arc electric discharge, being assisted by the electron-emissive substance.

The electric discharge causes ions to float in the electric discharge tube body, and to impinge upon the arc discharge electrode 5 from which the electron-emissive substance evaporates in the form of micro-particles which scatter and which then stick to the inner surface of the glow discharge electrode 3 without emitting inward of the discharge tube body. These particles sticking to the inner surface of the glow discharge electrode 3 can be reused as the electron-emissive substance.

Although it has been explained in this embodiment of the present invention that the opening 3*b* is formed in the lower side of the glow discharge electrode 3 as viewed in FIG. 1, the opening 3*b* may also be formed in the upper side thereof. In this case, the small hole 3*c* for stabilizing the electric discharge can be eliminated.

Figure 3:
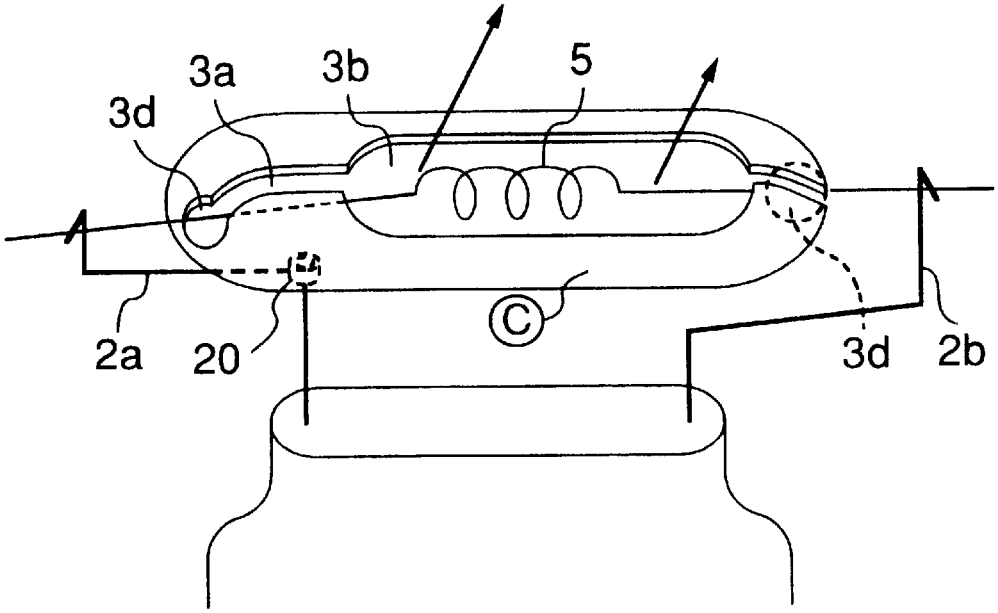
FIG. 3 is a perspective view illustrating an electrode device in a second embodiment of the present invention.

Referring to FIG. 3 which is a perspective view illustrating a second embodiment of the present invention, support leads 2*a*, 2*b* are bent at a substantially right angle in the inter mediate parts thereof, the position at which the support lead 2*a* is bent being higher than the position at which the support lead 2*b* is bent, as viewed in FIG. 3. A tube-like glow discharge electrode 3 is supported or fixed at the bottom part to the horizontal part the support lead 2*a*. For example, the bottom part of the tube-like glow discharge electrode 3 is welded to the horizontal part of the support lead 2*a* at a point 20. The other support lead 2*b* is prevented from being contact with the glow discharge electrode 3 since it is bent at a position at which the support lead 2*a* is bent. The top end parts of the support leads 2*a*, 2*b* are spirally wound so as to form hold parts for holding lead wire parts of an arc discharge electrode 5. Holes 3*d* formed in the opposite end parts of the tube-like glow discharge electrode 3 have an inner diameter which is relatively larger than the diameter of the lead wires of the arc discharge electrode 5, preventing the lead wires from making contact with the glow discharge electrode 3.

It is noted that the slot 3*a* and the opening 3*b* may face downward as shown in FIG. 1 although they face upward in the arrangement shown in FIG. 3. However, in this case, it is preferable to form a small hole for stabilizing electric discharge in the top part of the glow discharge electrode 3.

Figure 4:
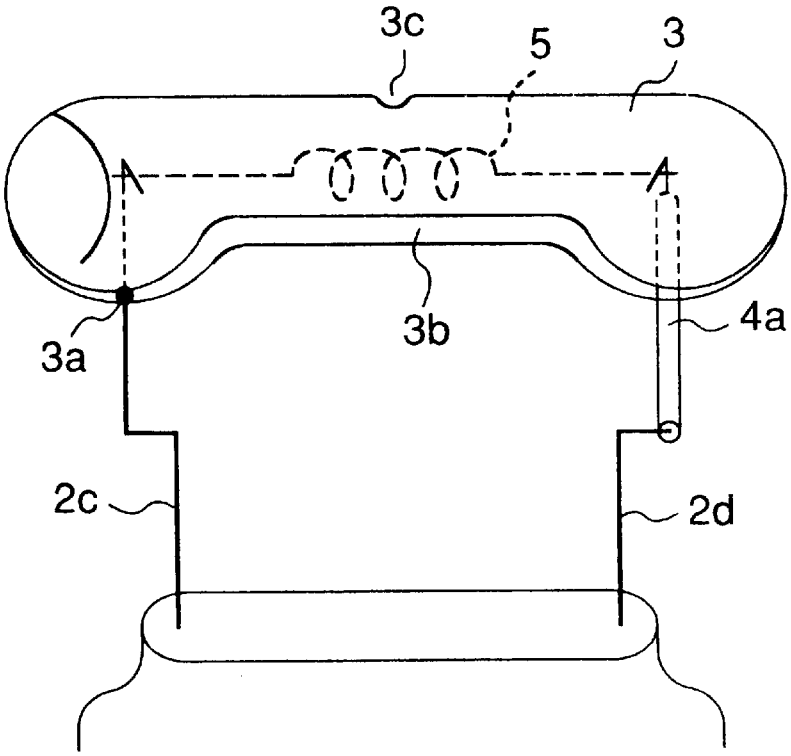
FIG. 4 is a perspective view illustrating an electrode device in a third embodiment of the present invention.

Referring to FIG. 4 which is a perspective view illustrating a third embodiment of the present invention, support leads 2*c*, 2*d* are bent by substantially right angles at the same height as viewed in FIG. 4 so as to obtain a wide space between the upper parts of the support leads 2*c*, 2*d*. The upper end parts of the lead wires 2*c*, 2*d* enter the inside of a tube-like glow electrode 3 through a slot 3*a* in the electrode 3 in order to support lead wires extending from an arc discharge electrode 5, similar to those explained in the second embodiment (refer to FIG. 3). The support lead 2*c* is welded to the glow discharge electrode 3 at the slot 3*a* in the latter, and the upper end part of the other support lead 2*d* is covered with an insulator 4*a* so as to prevent electrical contact with the glow discharge electrode 3 at a position where it passes through the slot 3*a*. A insulator pipe may be used as the insulator 4, in which the support lead 2*d* is inserted.

Figure 5:
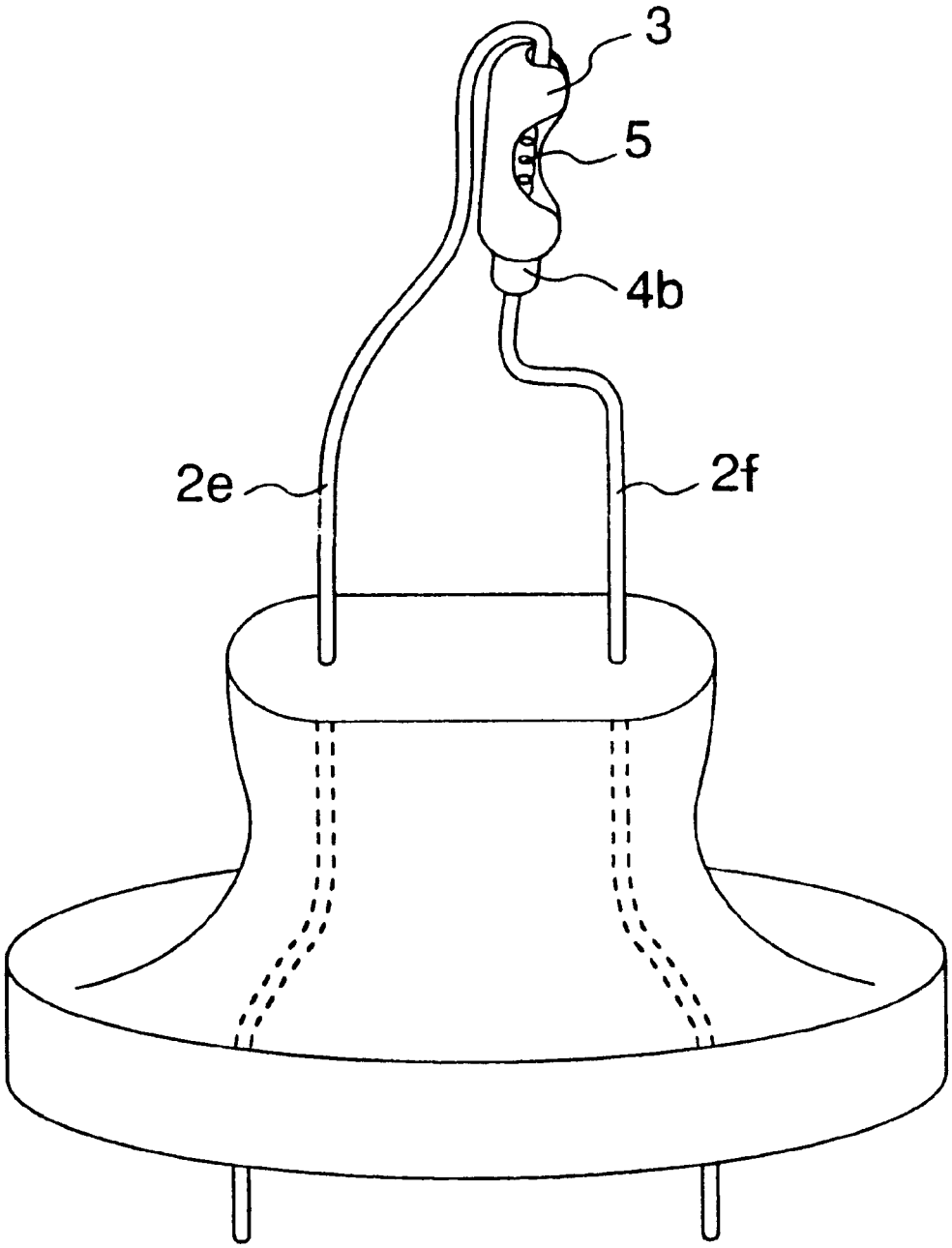
FIG. 5 is a perspective view of an electrode device in a fourth embodiment of the present invention.

Referring to FIG. 5 that is a perspective view illustrating a fourth embodiment of the present invention which is similar to the first embodiment, except that the glow discharge electrode 3 and the arc discharge electrode are laid so as to extend along the longitudinal axis of the discharge tube body. A support lead 2*e* is welded to the rear surface of the lower part of the tube-like glow discharge electrode 3 (as viewed in FIG. 5) at a one point in order to ensure electrical contact with the electrode 3, and a support lead 2*f* is covered with an insulator 4*b* at a position where it passes through a slot 3*a* in the glow discharge electrode 3 in order to prevent electrical contact with the glow discharge electrode 3.

Reference Example

Two electrode devices as those explained in the first embodiment of the present invention were arranged in a glass tube 10 at opposite ends of the latter, the openings 3*a* of the glow discharge electrodes facing with each other. The glass pipe 12 had a pipe diameter of 25.5 mm and a length of 4.5 mm. The tube-like glow discharge tube 3 was made of Ni and had a pipe diameter of 4.5 mm, a thickness of 0.15 mm, a slot 3*a* width of 0.5 mm, and an opening 3*b* width of 3 mm. The gap between a plane defined by the opening 3*b* and the arc discharge electrode (filament coil) 5 was set to 1.5 mm. The filament coil was formed of 20 W triplet coils on which ternary oxide (Ba, Ca and Sr) was carried, having a winding diameter of 1.5 mm and a length of 3 mm. Further, the inner surface of the glass tube 10 was coated thereover with a three wavelength fluorescent substance 11 (Ba, Ca and Sr), and argon gas at a pressure of 5 torr and mercury vapor at a vapor pressure of 0.006 mm are charged in the glass tube so as to form a 20 W fluorescent lamp. It is noted that reference numeral 13 denotes pins connected to terminals of a power source, and 14 denotes a base 14.

The thus prepared fluorescent lamp according to the present invention was turned on so as to measure the brightness at measuring lamp points (a), (b), (c), (d) and (e). A conventional 20 W fluorescent lamp was turned on so as to measured the brightness at the same points. The results of the measurements are summarized in table 1.

TABLE 1

| Measuring Point | (a) | (b) | (c) | (d) | (e) |
|---|---|---|---|---|---|
| The Invention | 3,240 | 6,510 | 9,980 | 6,560 | 4,040 |
| Conventional | 3,140 | 6,030 | 9,010 | 5,870 | 3,930 |

From Table 1, it is understood that the brightness of the fluorescent lamp according to the present invention is substantially equal to that of the conventional one at points (a) and (e), but is higher in the center part of the glass tube by 10 to 15%.

Figure 7:
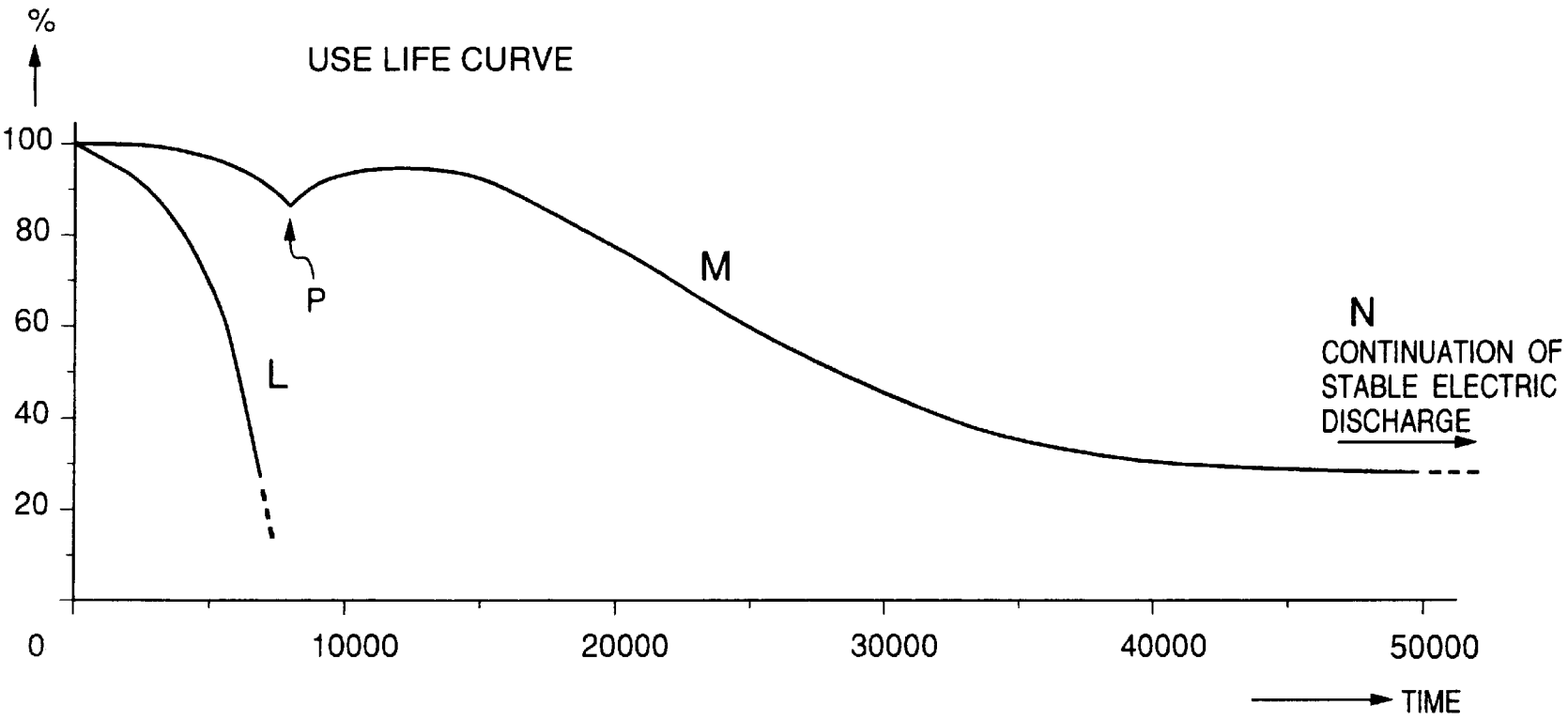
FIG. 7 is a graph showing bright characteristics of the fluorescent lamp shown in FIG. 6 and a conventional fluorescent lamp.

FIG. 7 is a graph which shows characteristics of use lives of the fluorescent lamp according to the present invention and the conventional fluorescent lamp.

The characteristic of the use life of the conventional fluorescent lamp L exhibits such that the brightness abruptly drops before the conducting period exceeds 10,000 hours, that is, the use life runs out before the elapse of 10,000 hours. Contrary, although the brightness of the fluorescent lamp according to the present invention drops more or less just before the conducting time exceeds 10,000 hours, the brightness returns up to a high value which is substantially maintained until the conducting time exceeds about 15,000 hours, and then, it gradually lowers after the conducting time exceeds 20,000 hours. After passage of 50,000 hours, the brightness comparatively drops, but is maintained in a stable electric discharge condition. Thus, the fluorescent lamp according to the present invention can have a long use life in comparison with the conventional one. It is considered that the drop in brightness at a point P just before the conducting time exceeds 10,000 hours, is caused by such a fact that substantially no electron-emissive substance has been evaporated and scattered from the arc discharge electrode. However, it is also considered that the electron-emissive substance which has stuck to the inner surface of the glow discharge electrode becomes effective thereafter so as to return the brightness up to a high value.

As mentioned above, with the electric discharge electrode device according to the present invention, the electron-emissive substance which has been evaporated and scattering from the arc discharge electrode due to ion bombardment, are trapped to the inner surface of the tube-like glow discharge electrode without consuming away by scattering, and can be reused at the inner surface of the glow discharge electrode, thereby it is possible to prolong the use life thereof.

According to the present invention, since the arc discharge electrode is inserted in the tube-like glow discharge electrode which can be therefore supported by the arc discharge electrode, the electrode device can be small-sized so that a thin electric discharge tube can be provided. Further, since a gap between the electrode device and the inner surface of the thin electric discharge tube body can be set to be large, the shadow of the electrode device is substantially invisible from the outside of the electric discharge tube.

Since the gap between the arc discharge electrode and the glow discharge electrode may be set to relative small, that is, about 1 to 2 mm, the particles of the electron-emissive substance having been evaporated and scattered are soon trapped at the inner surface of the glow discharge electrode, and substantially no electron-emissive substance consumes away from the glow discharge electrode, thereby it is possible to prevent occurrence of blackening on the wall surface of the electric discharge tube body. Thus, it is possible to provide a long-life electrode device.

The glow discharge electrode and the arc discharge electrode are integrally incorporated with each other, and they move together even though vibration occurs, thereby it is possible to prevent the electric discharge from flickering. Further, the positioning of the glow discharge electrode with respect to the arc discharge electrode can be facilitated. Thus, the manufacture of the electric discharge electrode device can be facilitated so as to reduce the cost thereof, and the automation for production of the electrode device can be also facilitated.

If an electron-emissive substance such as cesium or valium may be applied to the inner surface of the tube-like glow discharge electrode, or alloy powder of Zr and Al is clad to the one side of this electrode while powder of $Ti_3Hg$ is clad to the other side thereof, dripping of mercury is not required so that detrimental gas can be adsorbed, thereby it is possible to prolong the use life of the electrode device.

A conventional electric discharge tube is likely to rise up its operating temperature. In particular, a conventional fluorescent lamp raises up its temperature up to a value of 100 to 150° C. so as to promote the deterioration. However, the fluorescent lamp according to the present invention raises it temperature of the fluorescent lamp measured at the outer surface of the glass tube body, up to a lower value of 20 to 30° C., so that the above-mentioned problem is not caused.

Although the present invention has been explained in the specific embodiment form, the present invention should not be limited to the embodiments and the reference example, but can be widely modified within a scope defined by the appended claims. For example, it has been explained in the above-mentioned embodiment that the filament electrode is used as the arc discharge electrode, but a rod-like electrode containing the electron-emissive substance can be also effectively used as the arc discharge electrode in the electrode device according to the present invention.

What is claimed is:

1. An electrode device for an electric discharge tube including an electric discharge tube body having opposing ends and a longitudinal axis, and base members fitted therein, respectively at said opposing ends, said electrode device being provided at each of said opposing ends of said electric discharge tube body, said electrode device comprising:

a stem fixed to each of said base members;

two base pins extended through each of said base members and each said base pin having a first end extended from the base member and outward of said electric discharge tube body and a second end projected from the base member outward and inward of said electric discharge tube body, respectively, when said base member is fitted in said end of said discharge tube body, two support leads each having a first end and a second end connected to a respective said second end of said base pins;

an arc discharge electrode having ends each connected to a respective first end of said support leads and carrying an electron-emissive substance; and a tubular glow discharge electrode having closed opposite end parts and surrounding said arc discharge electrode, said tubular glow discharge electrode being formed with a longitudinal slot extended into said closed opposite end parts thereof, said first ends of said support leads being extended into said tubular glow discharge electrode through the slot in the closed opposite end parts of said glow discharge electrode, and said glow discharge electrode being supported by at least one of said support leads.

2. An electrode device for an electric discharge tube as set forth in claim 1, wherein said arc discharge electrode is a filament coil electrode.

3. An electrode device for an electric discharge tube as set forth in claim 1, wherein said arc discharge electrode is a sintered metal electrode.

4. An electrode device for an electric discharge tube as set forth in any one claims 1, 2 and 3, wherein said glow discharge electrode and said arc discharge electrode are extended in a direction orthogonal to the longitudinal axis of said electric discharge tube body.

5. An electrode device for an electric discharge tube as set forth in any of claims 1, and 3, wherein said glow discharge electrode and said arc discharge electrode are extended in a direction in which the longitudingal axis of said electric discharge tube body extends.

6. An electrode device for an electric discharge tube having an electric discharge tube body with ends and a longitudinal axis, and having bases fitted therein, respectively at said ends, said electrode device being provided at each of said ends of said electric discharge tube body, said electrode device comprising:

a stem fixed to each of said bases;

two base pins extended through each said base, each base pin having a first end and a second end projected from the base outward and inward of said electric discharge tube body when said base is fitted on said end of said discharge tube body;

two support leads each having a first end connected to a respective said second end of said base pins;

an arc discharge electrode having opposing ends each connected to a respective second end of said support leads and carrying an electron-emissive substance; and a tubular glow discharge electrode having closed opposing ends and surrounding said arc discharge electrode, said tubular glow discharge electrode being formed with a longitudinal slot extended into said closed opposing ends, said opposing ends of said arc discharge electrode being extended through the slot in the closed opposing ends of said tubular glow discharge electrode, and said tubular glow discharge electrode being supported by at least one of said support leads.

7. An electrode device for an electric discharge tube comprising:

a stem for fixing to a base that can be inserted into an electric discharge tube body;

first and second support leads each having an end extending from said stem;

an arc discharge electrode having opposing ends each connected to a respective said end of one of said first and second support leads, said arc discharge electrode carrying an electron-emissive substance; and a tubular glow discharge electrode surrounding said arc discharge electrode and having a longitudinal slot extended into opposing ends of said tubular glow discharge electrode, said opposing ends of said arc discharge electrode and respective said ends of said support leads extending into said slot in said opposing ends of said tubular glow discharge electrode, said tubular glow discharge being supported by one of said support leads.

* * * * *